United States Patent [19]

Taniguchi et al.

[11] Patent Number: 4,672,266

[45] Date of Patent: Jun. 9, 1987

[54] THIN FILM LIGHT EMITTING ELEMENT

[75] Inventors: Koji Taniguchi, Nara; Koichi Tanaka; Takashi Ogura, both of Tenri, all of Japan

[73] Assignee: Sharp Kabushiki Kaisha, Osaka, Japan

[21] Appl. No.: 645,078

[22] Filed: Aug. 28, 1984

[30] Foreign Application Priority Data

| | | | |
|---|---|---|---|
| Oct. 25, 1983 | [JP] | Japan | 58-200258 |
| Mar. 27, 1984 | [JP] | Japan | 59-59941 |
| Mar. 28, 1984 | [JP] | Japan | 59-64143 |

[51] Int. Cl.[4] ..... H01J 1/62

[52] U.S. Cl. ..... 313/509; 313/503

[58] Field of Search ..... 313/503, 509, 507, 513, 313/498

[56] References Cited

U.S. PATENT DOCUMENTS

| | | | |
|---|---|---|---|
| 4,213,074 | 7/1980 | Kawaguchi et al. | 313/509 |
| 4,287,449 | 9/1981 | Takeda et al. | 313/509 |
| 4,416,933 | 11/1983 | Antson et al. | 313/509 |
| 4,418,118 | 11/1983 | Lindfors | 313/509 |

FOREIGN PATENT DOCUMENTS

| | | | |
|---|---|---|---|
| 0015689 | 2/1979 | Japan | 313/509 |

*Primary Examiner*—David K. Moore

*Attorney, Agent, or Firm*—Birch, Stewart, Kolasch and Birch

[57] ABSTRACT

A thin film light emitting element including a light emitting layer and first and second dielectric layers which interpose opposite faces of the light emitting layer. The light emitting layer is made of a compound semiconductor material and an activator material such that the compound semiconductor material and the activator material are set at a composition substantially equal to a stoichiometric composition.

19 Claims, 14 Drawing Figures

THIN FILM LIGHT EMITTING ELEMENT

BACKGROUND OF THE INVENTION

The present invention generally relates to electrical components and more particularly, to a thin film light emitting element including a light emitting layer which effects electroluminescence in response to the application of an electric field thereto. The light emitting element is made of a compound semiconductor material, e.g. ZnS, etc. as its base material and an activator material such that the compound semiconductor material and the activator material are set at a stoichiometric composition in order to remarkably stabilize light emitting characteristics of the light emitting layer.

Conventionally, there have been proposed thin film light emitting elements having a structure of two insulating films, in which a light emitting layer made of a compound semiconductor m.aterial such as ZnS, ZnSe, etc. is interposed between first and second dielectric layers. In the known thin film light emitting elements, an activator such as various rare earth elements, transition metals, etc. is doped in the compound semiconductor material in order to secure high dielectric strength, luminous efficiency and operational stability when the known thin film light emitting elements are subjected to a high AC drive voltage of about $10^6$ V/cm. Especially, ZnS:Mn type thin film light emitting elements each including a light emitting layer made of zinc sulfide (ZnS) as its base material and manganese (Mn) as its activator are put to practical use for matrix type planar display units of information processing apparatuses, television sets, etc. and a fundamental structure of the prior art ZnS:Mn type thin film light emitting elements is shown in FIG. 1. Each of the prior art ZnS:Mn type thin film light emitting elements include a glass substrate 1, a transparent electrode 2 made of $In_2O_3$, $SnO_2$, etc., a first dielectric layer 3, a light emitting layer 4, a second dielectric layer 5 and a back electrode 6 made of Al which are stacked one on another in this order. The first dielectric layer 3 is of a single-layer film or a multilayer film formed by sputtering or electron beam evaporation of $Y_2O_3$, $Ta_2O_5$, $TiO_2$, $Al_2O_3$, $SiO_2$, $BaTiO_3$, $Si_3N_4$, etc. The light emitting layer 4 is obtained by electron beam evaporation of a sintered pellet made of ZnS and Mn mixed with each other. At this time, in the sintered pellet, Mn acting as the activator is added, at a composition required for obtaining desired light emitting characteristics, to ZnS acting as the base material and therefore, 0.05–2.5% by weight of Mn is uniformly doped in ZnS. Meanwhile, the second dielectric layer 5 is made of one selected from the group of materials of the first dielectric layer 3 such that the light emitting layer 4 is embedded between the first and second dielectric layers 3 and 5. The back electrode 6 is prepared by employing a resistance wire heating method. The transparent electrode 2 and the back electrode 6 are connected to an AC power source such that a drive voltage is applied to the prior art thin film light emitting elements. The prior art ZnS:Mn type thin film light emitting elements referred to above have such features as light emission at a high brightness upon application of an AC electric field of a few kHz thereto and a long life.

When the prior art ZnS:Mn type thin film light emitting elements are subjected to the drive voltage, an electric field is generated in the light emitting layer 4 so as to excite and accelerate electrons in a conduction band such that the electrons are provided with a large amount of energy. The electrons, in turn, excite luminous centers of Mn through collision therewith, so that the luminous centers of Mn emit light of yellowish orange color when returning to the ground state. In the case where rare earth fluorides, etc. are used for the luminous centers in place of Mn, various luminescent colors such as red, green, blue, white, etc. specific to the respective rare earth fluorides, etc. are obtained.

Referring to FIG. 2, characteristics of relation between luminous brightness and applied voltage (hereinbelow, referred to as "B-V characteristics") of the known thin film light emitting elements of FIG. 1 is shown. It will be readily seen from FIG. 2 that the applied voltage has a threshold value. Namely, when the applied voltage exceeds a threshold voltage Vth, the luminous brightness increases suddenly. When the applied voltage is further raised, the luminous brightness reaches a saturated state. However, this characteristic curve is located at a lower voltage side as shown by the broken line in FIG. 2 immediately after manufacture of the prior art elements. Then, this characteristic curve shifts to a higher voltage side during operation of the prior art elements. In order to obtain a stable characteristic curve, the prior art elements after manufacture thereof are required to be operated for a predetermined time period and then, are driven at the position shown in the solid line in FIG. 2, where the characteristic curve is fixed. By performing this initial operation (referred to as a "stabilizing treatment", hereinbelow), stable electroluminescence corresponding to the applied voltage is obtained.

It is well known as shown in FIG. 3 that the prior art thin film light emitting elements have such a hysteresis characteristic that there exists at any identically applied voltage a difference in value of the luminous brightness between a process for raising the applied voltage and a process for lowering the applied voltage. When light, an electric field, heat, etc. are applied to the known thin film light emitting elements having this hysteresis characteristic, the known thin film light emitting elements are excited to a state of luminous brightness corresponding to the strength of the applied light, electric field, heat, etc. and are maintained at a high luminous brightness even when having been returned to an original state by removing the light, electric field, heat, etc., thereby imparting a so-called memory effect to the known thin film light emitting elements. Consequently, at present, information display units based on the memory effect attract public attention.

More specifically, referring to FIG. 4, there is shown one example of the B-V characteristics of the known thin film light emitting elements. Electrons, which are excited in a conduction band and accelerated by an electric field induced in the light emitting layer in response to application of an AC voltage to the known thin film light emitting elements, obtains a sufficiently large amount of energy so as to act as free electrons. The free electrons are attracted to interfaces of the light emitting layer and accumulated thereon so as to cause internal polarization. At this time, since the free electrons moving at a high velocity excite luminous centers of Mn, etc. directly, the excited luminous centers emit electroluminescent light of yellowish orange color, etc. when returning to the ground state as described earlier. In FIG. 4, when write pulses of a voltage higher than the threshold voltage Vth are applied to the known thin film light emitting elements, the electroluminescent light is set to a state of high luminous brightness in accordance with the characteristic curve. Subsequently, when the applied voltage is lowered to a sustaining voltage Vs for generating sustaining pulses, the internal polarization of a high electric field produced by the write pulses is sustained and the electroluminescent light is maintained at the state of high luminous brightness. Then, when the applied voltage is further lowered to an erasing voltage Ve for generating erasing pulses, the internal polarization sustained in the light emitting layer vanishes suddenly such that the electroluminescent light is set to an erased state. Accordingly, even if the sustaining pulses of the sustaining voltage Vs are again applied to the known thin film light emitting elements in the erased state, it is impossible to obtain the electroluminescent light. When the sustaining voltage Vs for generating the sustaining pulses is selected and proper values are, respectively, assigned to the write and erasing pulses, it becomes possible to achieve the memory effect of the electroluminescence, which is based on the above described hysteresis characteristic. It is to be noted that a potential difference between the characteristic curve at the time of rise the of the applied voltage and that at the time of the drop of the applied voltage is referred to as a memory width Vm. By utilizing the memory effect based on the hysteresis characteristic, it becomes possible, for example, to easily increase the number of lines of electrodes in a display method employing an X–Y matrix type electrode structure, thereby enabling display of high resolution and high density.

It is also known that the above described hysteresis characteristic can be obtained by properly controlling the concentration of the activator (for example, Mn) in the base material (for example, ZnS, ZnSe) of the light emitting layer.

However, the known thin film light emitting elements have such an inconvenience that, since the memory width Vm gradually increases to a saturated state as the known thin film light emitting elements are operated immediately after manufacture thereof, the known thin film light emitting elements are required to be subjected to the time-consuming stabilizing treatment for stabilizing the B-V characteristics, thereby resulting in rise of the production cost.

Furthermore, the prior art thin film light emitting elements have such a disadvantage as operational instability with respect to the hysteresis characteristics.

SUMMARY OF THE INVENTION

Accordingly, an essential object of the present invention is to provide an improved thin film light emitting element which does not need a time-consuming stabilizing treatment and is suitable for mass production at low cost. The basis of such a conclusion of the present invention is that the increase of a threshold voltage Vth and a memory width Vm of a thin film light emitting element after manufacture thereof, which is associated with prior art thin film light emitting elements, is caused by the fact that a light emitting layer of the thin film light emitting element contains a number of lattice vacancies and is of a composition deviated from a stoichiometric composition.

Another important object of the present invention is to provide an improved thin film light emitting element of the above described type which is sufficiently high in reproducibility of its hysteresis characteristic, highly reliable in actual use and has a large memory width.

In accomplishing these and other objects according to one preferred embodiment of the present invention, there is provided an improved thin film light emitting element including a light emitting layer which effects electroluminescence in response to application of an electric field thereto, and first and second dielectric layers which interpose opposite faces of said light emitting layer therebetween, the improvement comprising: said light emitting layer made of a compound semiconductor material as its base material and an activator material added to said compound semiconductor material such that said compound semiconductor material and said activator material are set at a composition substantially equal to a stoichiometric composition.

In accordance with the present invention, since it becomes almost or totally unnecessary to perform the stabilizing treatment immediately after manufacture of the thin film light emitting element, mass production of the thin film light emitting element can be performed at low cost and production processes therefor are simplified.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
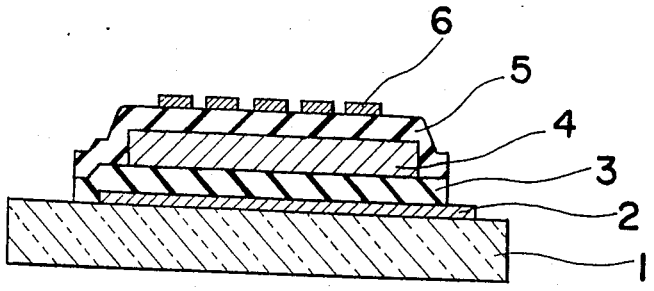
Fig. 1 PRIOR ART
FIG. 1 is a cross-sectional view of a prior art thin film light emitting element.
Figure 2:
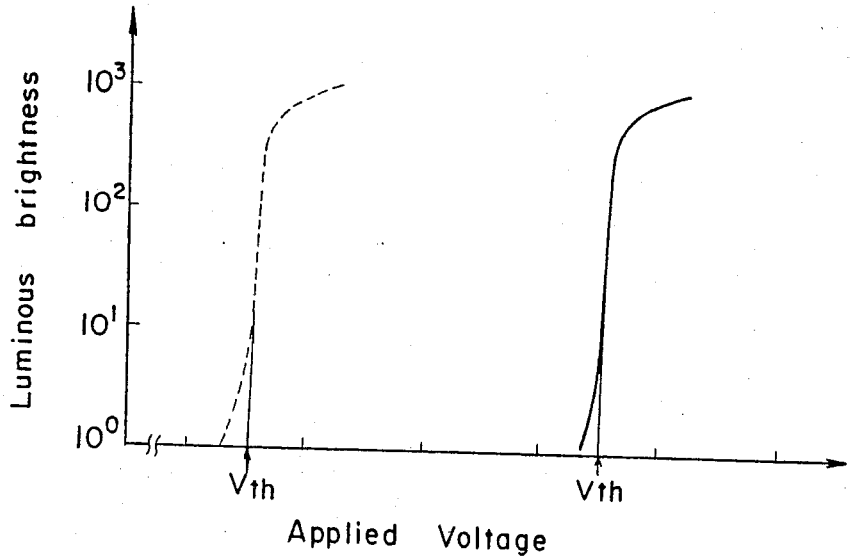
Fig. 2 PRIOR ART
FIGS. 2 to 4 are graphs showing B–V characteristics of the prior art thin film light emitting element of FIG. 1.
Figure 3:
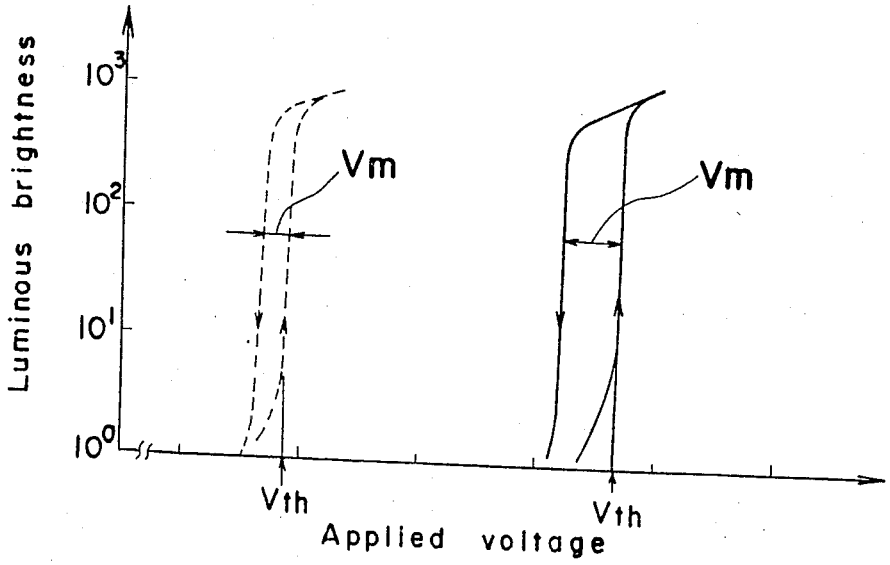
Fig. 3 PRIOR ART
Figure 4:
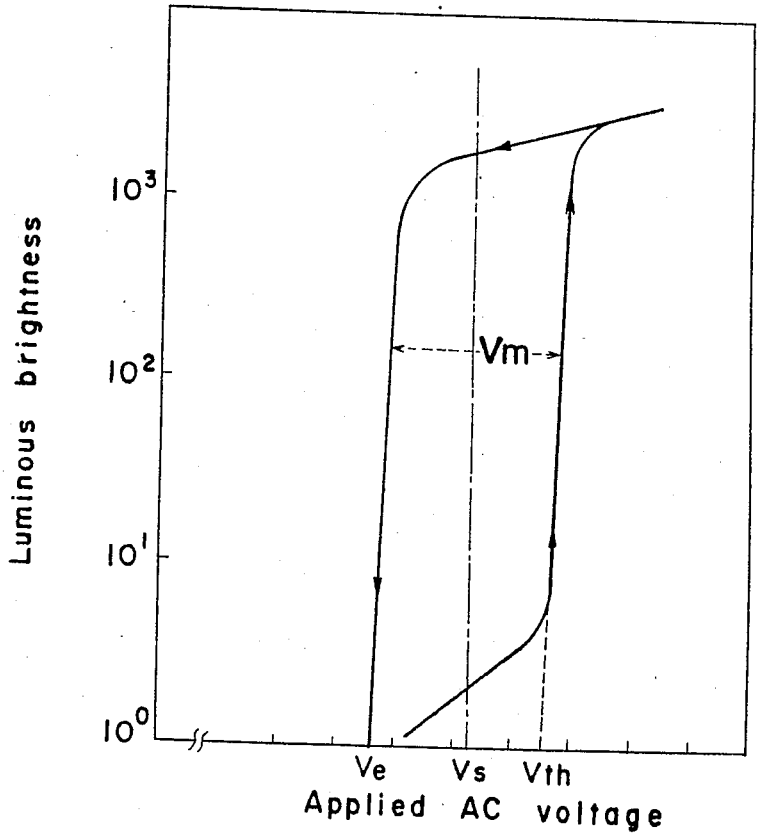
Fig. 4 PRIOR ART
Figure 5:
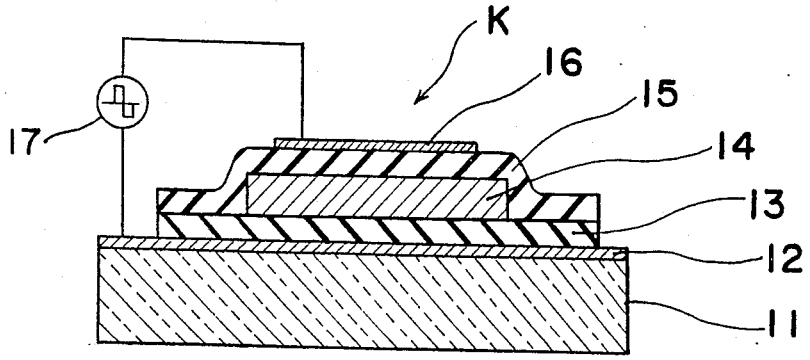
FIG. 5 is a cross-sectional view of a thin film light emitting element according to the present invention.

Hereinbelow, the above described conclusion of the present invention will be described in that the increase of a threshold voltage Vth and a memory width Vm of a thin film light emitting element after manufacture thereof, which is associated with prior art thin film light emitting elements, is caused by such a fact that a light emitting layer of the thin film light emitting element contains a number of lattice vacancies and is of a composition deviated from a stoichiometric composition. When a voltage is applied between a transparent electrode and a back electrode, an electric field corresponding to a dielectric constant of each of layers interposed therebetween is induced in each of the layers. However, in the light emitting layer of ZnS, an electric field adjacent to each of the interfaces between the light emitting layer and the first and second dielectric layers becomes relatively high through the bending of an energy band. This high electric field causes electrons to be emitted from a low level adjacent to each of the interfaces to a conduction band by a tunnel effect and these electrons are referred to as "primary electrons". The primary electrons obtain energy from the electric field so as to cause avalanche in the light emitting layer of ZnS such that a number of electrons are produced. These electrons also obtain a sufficient amount of energy from the electric field so as to excite luminous centers through collision therewith, whereby electroluminescence is effected. It will be understood from the foregoing that the threshold voltage Vth is determined by depths and densities of levels in a forbidden band in the vicinity of the interfaces between the light emitting layer and the first and second dielectric layers. In the case where the levels of small depths are present in a large amount, the primary electrons are produced by a low electric field. In proportion to decrease of the levels of small depths, a high electric field becomes required for producing the primary electrons. The levels of small depths are caused by vacancies of sulfur (S). The vacancies of S are produced at the time of formation of the light emitting layer of ZnS and during vacuum heat treatment of the light emitting layer after the formation and become extremely high in density in the vicinity of the surface of ZnS. Accordingly, the thin film light emitting element has a low threshold voltage Vth immediately after manufacture thereof. Thereafter, when the thin film light emitting element is operated, the vacancies of S are diffused by the high electric field and heat generation, so that density distribution of the vacancies of S is uniformed in the direction of the film thickness. Accordingly, the vacancies of S in the vicinity of the interfaces between the light emitting layer of ZnS and the first and second dielectric layers, whose density was high immediately after manufacture of the thin film light emitting element, decrease. In response to decrease of the vacancies of S in the interfaces, the threshold voltage Vth shifts to a higher voltage side. When the vacancies of S have been completely uniformed in the direction of the film thickness, the threshold voltage Vth is fixed such that the B-V characteristics are stabilized. The above description has been focussed on the light emitting layer of ZnS. However, in the case where the first and second dielectric layers, especially the second dielectric layer stacked on the light emitting layer is made of an oxide or in the case where the second dielectric layer is of a multi-layer construction composed of a plurality of layer portions and at least one of the layer portions, which is held in contact with the light emitting layer, is made of an oxide, atoms of oxygen are diffused from the oxide to the light emitting layer of ZnS, so that atoms of oxygen are shifted to the vacancies of S. This entry of atoms of oxygen into the vacancies of S also takes place during operation of the thin film light emitting element and exercises the same effect as that of diffusion of the vacancies of S on the B-V characteristics of the thin film light emitting element.

As is clear from the foregoing description, it will be concluded that a reason for a stabilizing treatment of the thin film light emitting element resides in is because the light emitting layer of the thin film light emitting element is of a composition which is deviated from the stoichiometric composition. If the light emitting layer is set at the stoichiometric composition, it becomes unnecessary to perform the time-consuming stabilizing treatment, with the elimination of the above described problems. It is to be noted that atoms entering into the vacancies are not restricted to an element composing the base material of the light emitting layer. For example, in the case where the light emitting layer is made of ZnS, atoms of group VI of the Periodic Table such as oxygen, etc., in addition to sulfur (S) can enter into the vacancies of S.

Hereinbelow, a thin film light emitting element K according to the present invention will be described with reference to FIGS. 5 to 10.

EMBODIMENT 1

The thin film light emitting element K includes a glass substrate 11, a transparent electrode 12 formed on the glass substrate 11 and a first dielectric layer 13 made of $Y_2O_3$ and formed on the transparent electrode 12. The thin film light emitting element K further includes a ZnS:Mn type light emitting layer 14, a second dielectric layer 15 and a back electrode 16 such that the transparent electrode 12 and the back electrode 16 are connected to an AC power source 17. The ZnS-Mn type light emitting layer 14 is stacked on the first dielectric layer 13 and is obtained by electron beam evaporation of a sintered pellet which is made of a compound semiconductor material of ZnS as its base material and Mn added thereto and acting as its activator. The ZnS-Mn type light emitting layer 14 is heat treated in atmosphere of sulfur (S) at a pressure of $10^{-5}$ to $10^{-4}$ Torr after the electron beam evaporation. At this time, temperature of the heat treatment of the light emitting layer 14 is properly set in the range of 100° to 900° C. The heat treatment of the light emitting layer 14 causes atoms of S in the atmosphere to enter into vacancies of S formed on the surface of the light emitting layer 14 so as to decrease density of the vacancies of S. Accordingly, since formation of irregular density of the vacancies of S is restricted in the direction of the film thickness, the light emitting layer 14 is set at a composition substantially equal to a stoichiometric composition. The second dielectric layer 15 is stacked on the light emitting layer 14 and is of a two-layer construction composed of an oxide layer of $Al_2O_3$, $Y_2O_3$, etc. held in contact with the light emitting layer 14 and a nitride layer abutting on the oxide layer such that the light emitting layer 14 is interposed between the first and second dielectric layers 13 and 15. The back electrode 16 is stacked on the second dielectric layer 15 and is made of Al, etc.

Figure 6:
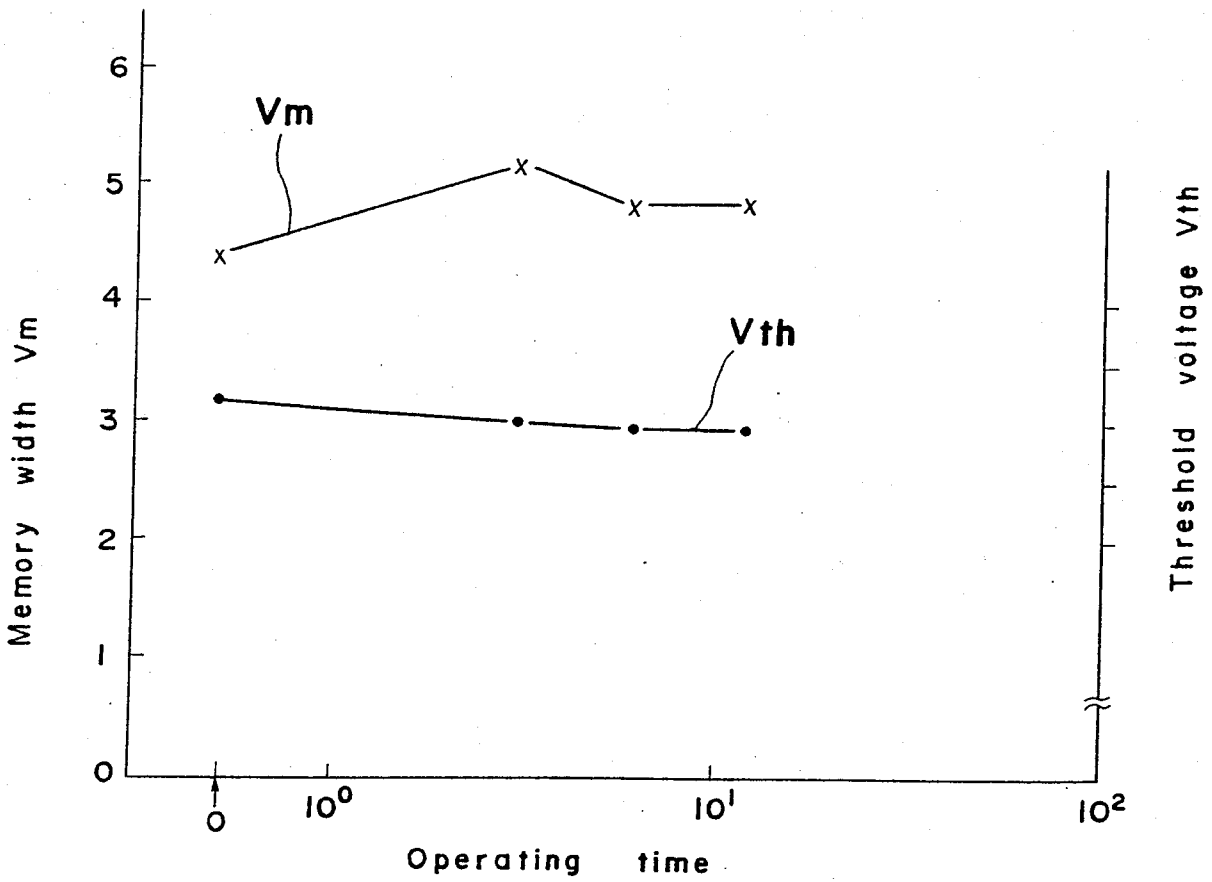

A threshold voltage Vth and a memory width Vm of the thin film light emitting element K manufactured by the above described processes behave from a point immediately after manufacture thereof as shown in FIG. 6. It will be readily understood from FIG. 6 that the threshold voltage Vth is fairly stable from the point immediately after manufacture of the thin film light emitting element K. Thus, the thin film light emitting element K is applicable to a display method not based on a hysteresis memory effect and does not need a subsequent stabilizing treatment. Although the memory width Vm varies slightly, variations of the memory width Vm are smaller than those of the prior art thin film light emitting elements. Thus, the hysteresis memory effect for practical use can be imparted to the thin film light emitting element K by the stabilizing treatment for a short time.

EMBODIMENT 2

The thin film light emitting element K includes a glass substrate 11, a transparent electrode 12 and a first dielectric layer 13 which are stacked one upon another in this order in the same manner as in the above embodiment 1. Subsequently, a ZnS-Mn type light emitting layer 14 is stacked on the first dielectric layer 13 by electron beam evaporation of a sintered pellet made of ZnS and Mn and then, is heat treated in atmosphere of oxygen at temperatures of 100° to 700° C. This heat treatment causes atoms of oxygen in the atmosphere to enter into vacancies of S formed on the surface of the ZnS:Mn type light emitting layer 14 so as to eliminate the vacancies of S. Consequently, since density of the vacancies of S on the surface of the light emitting layer 14 is reduced, uniform density distribution of the vacancies of S is obtained in the direction of the film thickness. The thin film light emitting element K further includes a second dielectric layer 15 stacked on the light emitting layer 14 and a back electrode 16 stacked on the second dielectric layer 15.

Figure 7:
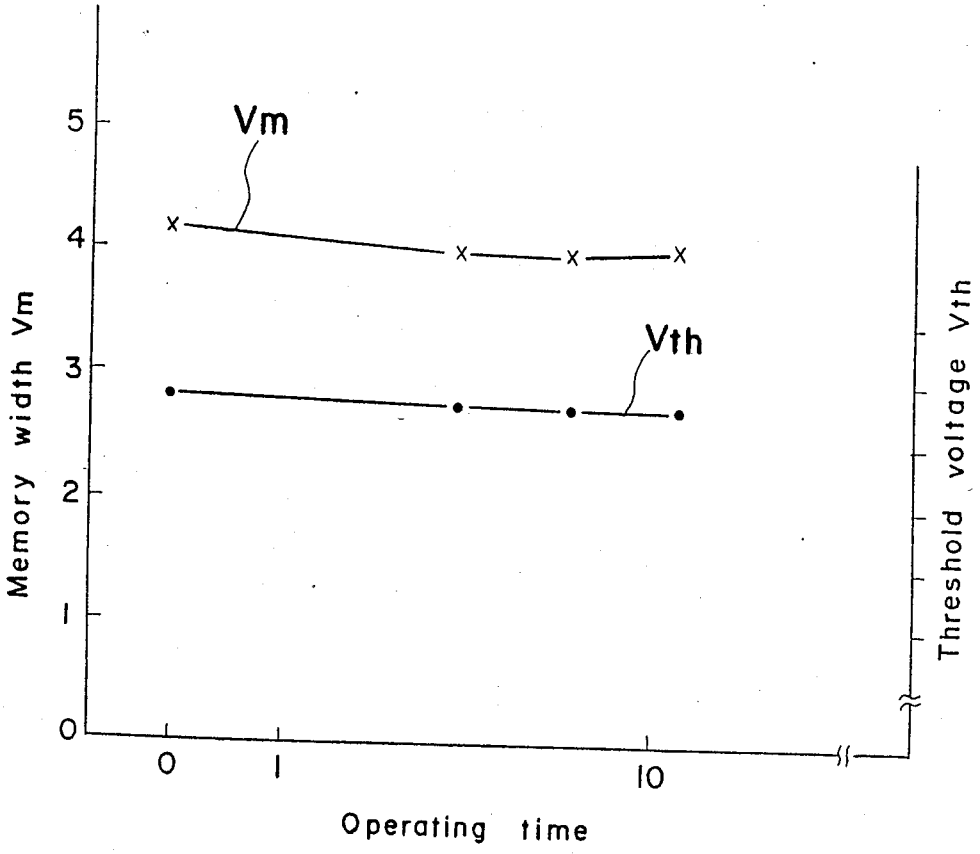
FIGS. 6 and 7 are graphs showing variations of a memory width and a threshold voltage of the thin film light emitting element of FIG. 5 with time.

A performance test revealed that a threshold voltage Vth and a memory width Vm of the thin film light emitting element K manufactured by the above described processes behave from a point immediately after manufacture thereof as shown in FIG. 7. It will be readily seen from FIG. 7 that both the threshold voltage Vth and the memory width Vm are remarkably stable from the point immediately after manufacture of the thin film light emitting element K. Thus, it becomes almost or totally unnecessary to perform a subsequent stabilizing treatment of the thin film light emitting element K.

In accordance with embodiments 1 and 2 of the present invention, since it becomes almost or totally unnecessary to perform the stabilizing treatment immediately after manufacture of the thin film light emitting element, mass production of the thin film light emitting element can be performed at low cost and production processes therefor are simplified.

Furthermore, in accordance with embodiments 1 and 2 of the present invention, since B-V characteristics of the thin film light emitting element are remarkably stable such that the threshold voltage Vth and the memory width Vm can be set accurately, reliable thin film light emitting elements can be obtained with high reproducibility.

EMBODIMENT 3

The thin film light emitting element K includes a glass substrate 11, a transparent electrode 12 formed on the glass substrate 11 and a first dielectric layer 13 stacked on the transparent electrode 12. The transparent electrode 12 is made of $In_2O_3$, $Sn_2O_3$, etc. while the first dielectric layer 13 is obtained by electron beam evaporation or sputtering of a dielectric thin film made of $SiO_2$, $Si_3N_4$, $Y_2O_3$, $Ta_2O_5$, etc. The thin film light emitting element K further includes a light emitting layer 14 formed on the first dielectric layer 13 by electron beam evaporation, a second dielectric layer 15 stacked on the light emitting layer 14 and a back electrode 16 made of Al deposited on the second dielectric layer 15 by a resistance wire heating method.

The light emitting layer 14 is made of zinc sulfide (ZnS) as its base material and manganese (Mn) so as to contain 0.5–0.8% by weight of Mn. The second dielectric layer 15 is made of the same materials as those of the first dielectric layer 13. Meanwhile, after formation of the light emitting layer 14, a vacuum heat treatment of the light emitting layer 14 for improving uniform distribution of Mn in ZnS and crystallizability of ZnS, and a stabilizing treatment of the light emitting layer 14 for setting the light emitting layer 14 at a stoichiometric composition are performed. As the base material of the light emitting layer 14, zinc selenide (ZnSe) can be employed in place of ZnS.

Figure 8:
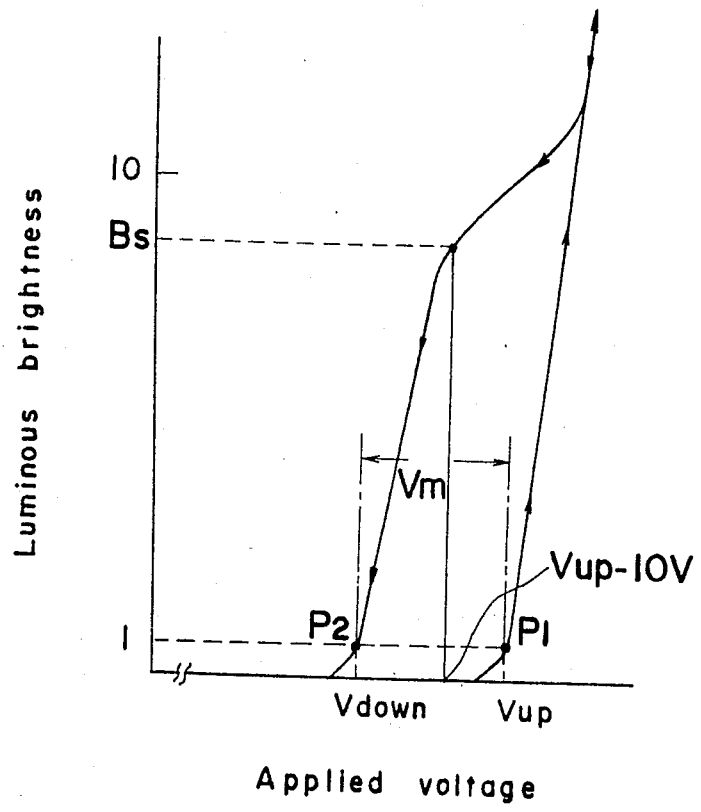
FIG. 8 is a graph showing B–V characteristics of the thin film light emitting element of FIG. 5.

FIG. 8 shows B-V characteristics of the thin film light emitting element K of embodiment 3 of the present invention. It can be seen from FIG. 8 that its luminous brightness changes upon variation of the applied voltage as indicated by the arrows of the characteristic curve. It is to be noted that characters Vup and Vdown denote voltages assuming a predetermined low luminous brightness when the applied voltage is raised and lowered, respectively. A memory width Vm which exhibits a hysteresis characteristic of the thin film light emitting element K is given by the equation:

$$Vm = Vup - Vdown$$

Meanwhile, character Bs denotes a luminous brightness at an applied voltage of (Vup − 10) volts. It will be readily understood from FIG. 8 that luminous brightness of the thin film light emitting element K has two values for the applied voltage, which can be utilized as a memory function. It is to be noted that whether or not thin film light emitting elements are generally provided with the memory function depends on the amount of Mn added to the light emitting layer.

Figure 9:
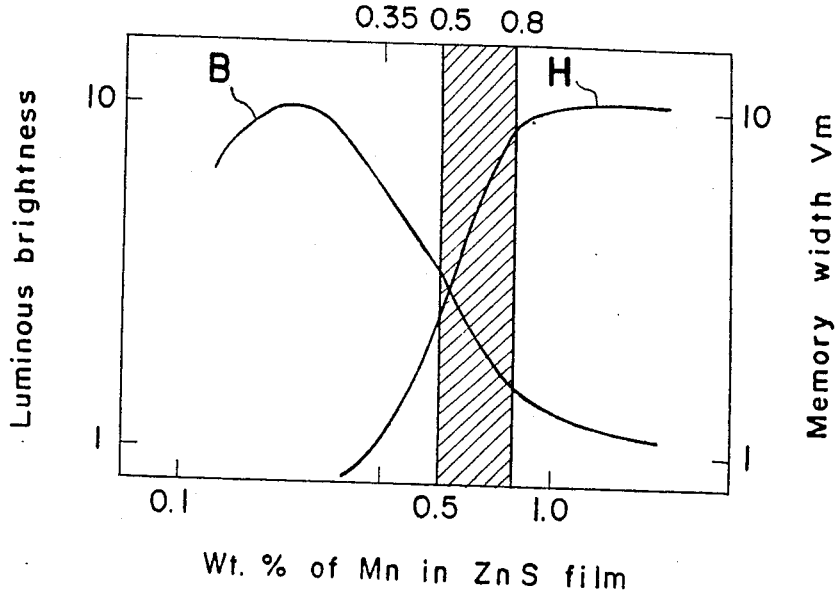
FIGS. 9 and 10 are graphs showing other characteristics of the thin film light emitting element of FIG. 5.

FIG. 9 shows dependence of luminous brightness (saturated brightness) and memory width Vm on amount (% by weight) of Mn added to the light emitting layer 14. It is seen from FIG. 9 that a hysteresis characteristic appears in the light emitting layer 14 containing not less than 0.35% by weight of Mn added to ZnS or ZnSe. In FIG. 9, characters H and B represent a characteristic curve for indicating the memory width Vm and a characteristic curve for indicating maximum luminous brightness, respectively. In order to obtain the hysteresis characteristic in the B-V curve, it is necessary to produce deep trap levels in view of an operational mechanism of the thin film light emitting element K, which is based on such an effect that internal polarization induced in the interfaces of the light emitting layer 14 in response to application of an AC voltage thereto is additionally applied to the applied voltage. Accordingly, it is considered that the deep trap levels produced in the light emitting layer 14 or in the interfaces between the light emitting layer 14 and the first and second dielectric layers 13 and 15 generates the hysteresis characteristic. In the case where the light emitting layer 14 contains less than 0.35% by weight of Mn, Mn added to the light emitting layer 14 is replaced by Zn of ZnS and is excited by a carrier attracted from one interface to the other interface of the light emitting layer 14 so as to function solely as luminous centers for emitting electroluminescent light, so that the hysteresis characteristic does not appear. However, in the case where the light emitting layer 14 contains not less than 0.35% by weight of Mn, Mn which produces the deep trap levels in ZnS or in the interfaces between the light emitting layer 14 and the first and second dielectric layers 13 and 15 is generated in addition to Mn functioning solely as the luminous centers, so that the hysteresis characteristic based on an effect for sustaining the induced internal polarization is obtained. Since a force for sustaining the internal polarization is increased upon rise of density of the deep trap levels due to increase of amount of Mn added to the light emitting layer 14, the memory width Vm widens. In the case where the light emitting layer 14 contains not less than 0.8% by weight of Mn, the memory width Vm assumes a substantially constant value and does not widen even if the amount of Mn added to the light emitting layer 14 is increased. It is surmised that this phenomenon takes place due to such a fact that since a threshold value for producing the deep trap levels for sustaining the internal polarization is determined by the base material of the light emitting layer 14, etc., the deep trap levels are not produced even if Mn is further increased. As a result, excessive Mn is disposed between lattices of ZnS so as to deteriorate crystallizability of ZnS or functions as the luminous centers of pairs of Mn, etc. so as to lower an efficiency of the thin film light emitting element K and raise an operating voltage of the thin film light emitting element K, thus resulting in deterioration of functions of the thin film light emitting element K for use in display units.

Figure 10:
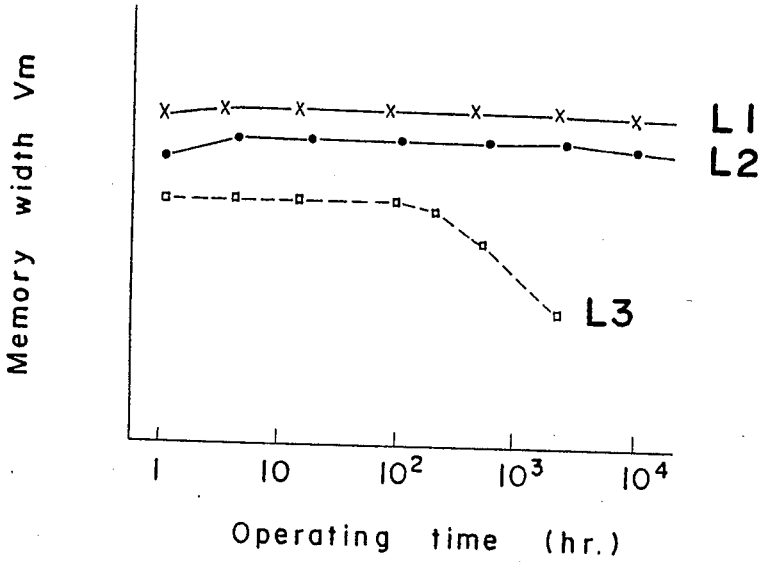

FIG. 10 shows variations of the memory width Vm of the thin film light emitting element K of embodiment 3 of the present invention with time when the thin film light emitting element K is subjected to AC pulse drive at a frequency of 300 Hz and at a pulse width of 50 microsec. In FIG. 10, solid lines Ll and L2 represent characteristic curves of the thin film light emitting element K, in which the light emitting layer 14 contains 0.6% by weight of Mn and 0.75% by weight of Mn, respectively, while a broken line L3 represents a characteristic curve of a comparative thin film light emitting element other than the thin film light emitting element K, in which the light emitting layer contains 0.4% by weight of Mn. Although the light emitting layer 14 of the thin film light emitting element K should contain not less than 0.35% by weight of Mn so as to impart the memory effect to the thin film light emitting element K as described above, it was proved as shown in the broken line L3 that the memory width Vm of the thin film light emitting element decreases after an operating time of several hundred hours in the case where the light emitting layer contains not less than 0.35 but less than 5% by weight of Mn. The broken line L3 reveals that the memory width Vm of the thin film light emitting element including the light emitting layer containing 0.4% by weight of Mn decreased after an operating time of 200 hours. This is probably because Mn forming the deep trap levels is influenced by the high electric field applied to the thin film light emitting element during operation thereof and heat generation through collision of hot electrons therewith so as to be incapable of sustaining the trap levels such that the force for sustaining the internal polarization decreases. However, in the case where the light emitting layer contains not less than 0.5% by weight of Mn, Mn forming the deep trap levels increases in amount. Accordingly, even if a small amount of the deep trap levels vanish at the time of light emitting of the thin film light emitting element, the hysteresis characteristic of the thin film light emitting element is not affected and thus, the memory width Vm is maintained at a constant value. Meanwhile, in the case where the light emitting layer contains not less than 0.8% by weight of Mn, the thin film light emitting element has the various defective characteristics referred to above. The solid lines L1 and L2 in FIG. 10 reveal that the memory width Vm of the thin film light emitting element K does not decrease even after an operating time of $10^4$ hours.

In accordance with embodiment 3 of the present invention, the thin film light emitting element has the stable hysteresis characteristic for a long time by setting the amount of Mn added to the sulfide as the base material of the light emitting layer at 0.5–0.8% by weight and is effectively applicable to planar display units.

Figure 11:
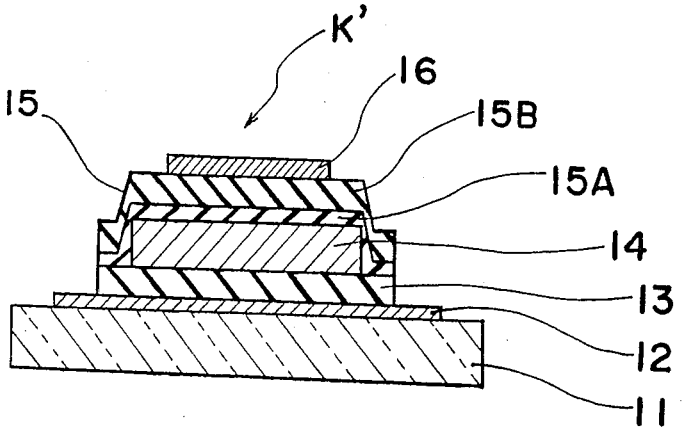
FIGS. 11 and 12 are a view similar to FIG. 5 and a graph similar to FIG. 6, respectively, particularly showing a modification thereof

Referring to FIG. 11, there is shown a thin film light emitting element K' which is a modification of the thin film light emitting element K. The modified thin film light emitting element K' includes a glass substrate 11 made of pyrex, soda glass, etc., a transparent electrode 12 stacked on the glass substrate 11, and a first dielectric layer 13 formed on the transparent electrode 12 by sputtering, electron beam evaporation, etc. The transparent electrode 12 is made of $In_2O_3$, $SnO_2$, etc. A light emitting layer 14 is formed on the first dielectric layer 13 and contains ZnS as its base material and Mn as its activator doped in ZnS by electron beam evaporation of a sintered pellet made of ZnS and Mn. At this time, in order to impart the hysteresis characteristic to the thin film light emitting element K'W', the light emitting layer contains 0.5–0.8% by weight of Mn acting as the activator. A second dielectric layer 15 of a two-layer construction including a metallic oxide layer 15A and a nitride layer 15B is formed on the light emitting layer 14. Furthermore, a back electrode 16 made of Al, etc. is deposited on the second dielectric layer 15 such that the transparent electrode 12 and the back electrode 16 are connected to an AC power source (not shown) for driving the modified thin film light emitting element K'.

Materials of the first dielectric layer 13 and the second dielectric layer 15 are properly selected from oxides consisting of $SiO_2$, $Al_2O_3$, $Y_2O_3$, $Ta_2O_5$, $TiO_2$, $GaTiO_2$, $GeO_2$, etc. or nitrides consisting of $Si_3N_4$, etc. High dielectric strength, high adhesive property in the interfaces, large humidity resistance, etc. are recited as general characteristics required of the dielectric layers. The oxide layer generally is excellent in adhesive property but poor in humidity resistance. On the other hand, the nitride layer is excellent in dielectric strength and humidity resistance but poor in adhesive property.

Meanwhile, in the case where a display unit based on the memory function of the thin film light emitting element is employed, it becomes possible to easily set the sustaining voltage Vs and to raise the contrasts of the display as the memory width Vm is increased. From this point of view, a study on stability of memory and the memory width Vm for the various material of the first and second dielectric layers 13 and 15 was conducted and revealed that the memory width Vm of the thin film light emitting element employing the nitride layer of $Si_3N_4$ is far smaller than that employing the metallic oxide layer of $SiO_2$, $Al_2O_3$, $Ta_2O_5$, etc. This is probably because if the first and second dielectric layers 13 and 15 are made of the oxide, atoms of oxygen in the first and second dielectric layers 13 and 15 affect the internal polarization at the interfaces between the light emitting layer 14 and the first and second dielectric layers 13 and 15 so as to increase the memory width Vm. By employing the first and second dielectric layers 13 and 15 made of the oxide, the hysteresis characteristic of the thin film light emitting element is stabilized and a certain memory effect can be obtained even after a long operating time. Although effects of the atoms of oxygen on the internal polarization have not thoroughly clarified as yet, it is surmised that since the atoms of oxygen in the first and second dielectric layers 13 and 15 are shifted to the vacancies of S produced at the time of formation of the light emitting layer 14 of ZnS so as to decrease density of the vacancies of S at the interfaces between the light emitting layer 14 and the first and second dielectric layers 13 and 15, the hysteresis characteristic is stabilized and the internal polarization is prevented from vanishing with the result that the memory width Vm increases.

Based on such a viewpoint, the first dielectric layer 13 is made of one selected from the metallic oxides consisting of $Y_2O_3$, $Ta_2O_3$, etc. By employing the first dielectric layer 13 made of the metallic oxide, one interface of the light emitting layer 14 is brought into contact with the metallic oxide so as to securely adhere thereto due to the above described characteristics of the oxide layer. Meanwhile, it can be also so arranged that the first dielectric layer 13 is made of SiON having an atom of oxygen. Meanwhile, in the second dielectric layer 15, the metallic oxide layer 15A is held in contact with the light emitting layer 14 and is made of $Y_2O_3$, $Al_2O_3$, etc., while the nitride layer 15B stacked on the metallic oxide layer 15A is made of $Si_3N_4$. By this arrangement of the metallic oxide layer 15A and the nitride layer 15B of the second dielectric layer 15, since the other interface of the light emitting layer 14 is brought into contact with the metallic oxide layer 15A containing atoms of oxygen and such an effect can be achieved that the metallic oxide layer 15A is coated with the nitride layer 15B, so that entry of moisture into the light emitting layer 14 is prevented by humidity resistance of the nitride layer 15B. The first and second dielectric layers 13 and 15 are formed by sputtering or electron beam evaporation. Furthermore, the metallic oxide layer 15A is formed into a thickness of 50 to 1000Å, while the nitride layer 15B is formed into a proper thickness in view of its dielectric characteristics and adhesive property.

Figure 12:
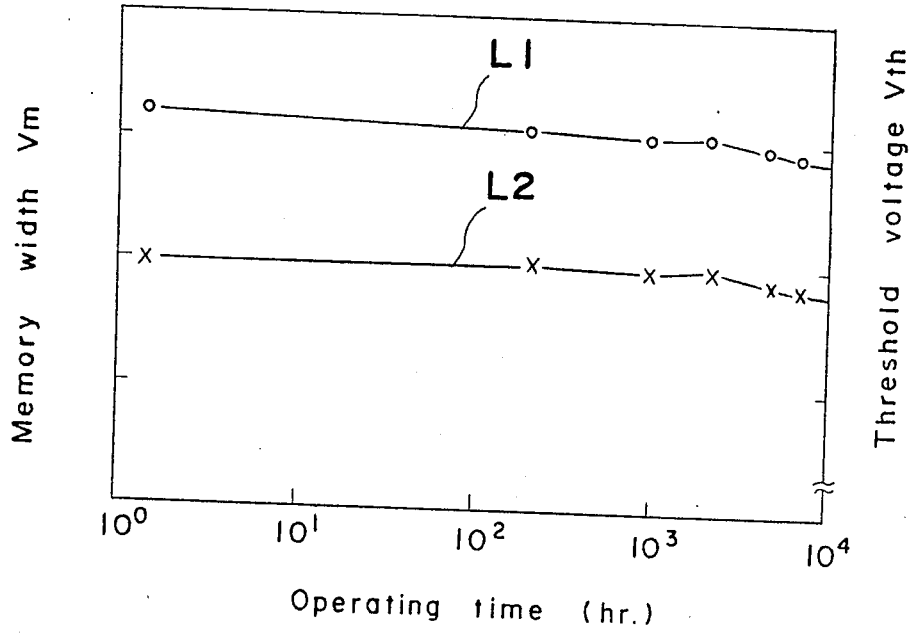

Referring to FIG. 12, there are shown characteristic curves indicative of variations of the memory width Vm and the threshold voltage Vth of the modified thin film light emitting element K' with time. In FIG. 12, lines L1 and L2 represent the characteristic curves of the threshold voltage Vth and the memory width Vm, respectively. It will be readily seen from FIG. 12 that operational characteristics of the modified thin film light emitting element K' are remarkably stable.

Meanwhile, in the modified thin film light emitting element K', it can be also so arranged that the first dielectric layer 13 is of a multi-layer construction and that the second dielectric layer 15 is of a three-layer construction including the metallic oxide layer 15A, the nitride layer 15B and another metallic oxide layer stacked on the nitride layer 15B so as to improve adhesive property between the second dielectric layer 15 and the back electrode 16.

Thus, it will be readily understood that the modified thin film light emitting element K' having a large memory width Vm exhibits stable characteristics for a long operating time so as to be applicable to a light emitting type display unit provided with a memory function for practical use.

Figure 13:
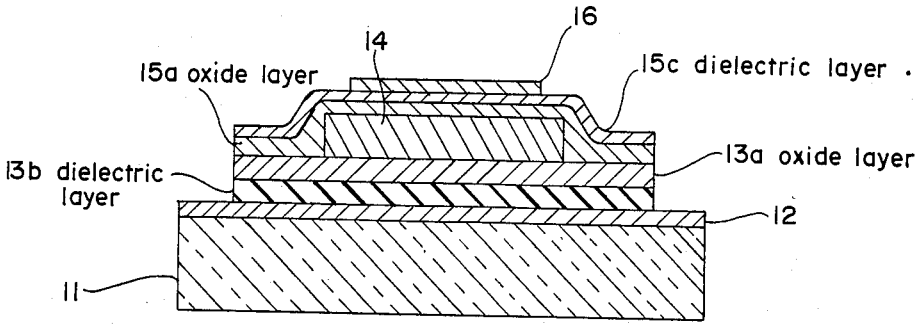
FIGS. 13 and 14 are cross-sectional views of a thin film light emitting element wherein both a first and a second dielectric light are of a multi-layer construction.

Referring to FIG. 13, there is shown a thin film light emitting element which is a further modification of the thin film light emitting element K. The modified thin film element includes a glass substrate 11, a transparent electrode 12 stacked on the glass substrate 11, and a first dielectric layer **13*b* formed on the transparent electrode 12. A first oxide layer 13*a* is formed on the first dielectric layer 13*b* and a light emitting layer 14 is positioned on the first oxide layer 13*a*. A second oxide layer 15*a* is positioned on top of the light emitting layer 14 so as to contact the first oxide layer 13*a*. A second dielectric layer 15*c* is formed on top of the second oxide layer 15*a*. Finally, a back electrode 16 is deposited on the second dielectric layer 15*c***.

Figure 14:
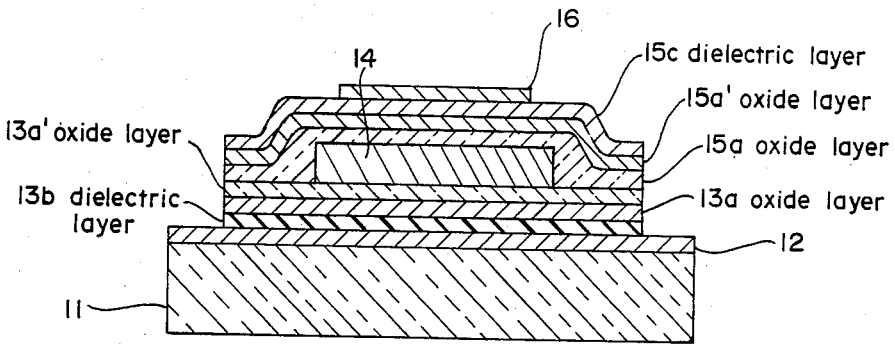

Referring to FIG. 14, there is shown another thin film light emitting element which is a modification of the thin film light emitting element K. The modified thin film light emitting element includes a glass substrate 11, a transparent electrode 12 stacked on the glass substrate 11 and a first dielectric layer **13*b* formed on the transparent electrode 12. The dielectric layer 13*b* has formed thereon a first oxide layer 13*a***. *A second oxide layer 13a'* is then positioned on top of the first oxide layer **13*a*. A light emitting layer 14 is formed on the second oxide layer 13*a'*. A third oxide layer 15*a* is positioned on the light emitting layer 14 so as to be in contact with the second oxide layer 13*a'*. A fourth oxide layer 15*a'* is positioned on the third oxide layer 15*a*. An additional dielectric layer 15*c* is formed on the fourth oxide layer 15*a'*. Finally, a back electrode 16 is positioned on the dielectric layer 15*c***.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. In a thin film light emitting element including a light emitting layer which effects electroluminescence in response to application of an electiic field thereto, and first and second dielectric layers which interpose opposite faces of said light emitting layer therebetween, the improvement comprising:

said emitting light layer made of a sulfide semiconductor material as its base material and a manganese activator material added to said semiconductor material such that cemiconductor material is a stoichiometric composition, said light emitting layer containing 0.5 to 0.8% by weight on manganese and;

said dielectric layers and said light emitting layers are in contact with each other.

2. The thin film light emitting element as claimed in claim 1, wherein at least one of said first and second dielectric layers is of a two-layer construction including an oxide layer portion held in contact with said light emitting layer and a lielectric layer portion abutting on said oxide layer portion such that said oxide layer portion is interposed between said light emitting layer and said dielectric layer portion.

3. The thin film light emitting element as claimed in claim 2 wherein both said first and second dielectric layers are of a multi-layer construction.

4. The thin film light emitting element as claimed in claim 2, wherein said one of said first and second dielectric layers further includes an additional oxide layer portion stacked on said dielectric layer portion.

5. A thin film light emitting element as claimed in claim 3, wherein said one of said first and second dielectric layers further includes an additional oxide layer portion stacked on said dielectric layer portion.

6. A thin film light emitting element, comprising a furst dielectric layer;

a light emitting layer disposed on the first dielectric layer and composed of a semiconductor base material selected from the group consisting of a sulfide and a selenide and a manganese activator material added to the semiconductor material such that said semiconductor material such that said semiconductor material is a stoichiometric composition, said light emitting layer containing 0.5 to 0.8% by weight of manganese; and a second dielectric layer disposed on the light emitting layer and in contace with said first dielectric layer.

7. The thin film light emitting element according to claim 6, wherein the second dielectric layer contains an oxide containing layer positioned adjacent to the light emitting layer and a nitride layer abutting the oxide layer such that the light emitting layer is interposed between the first and second dielectric layers.

8. The thin film light emitting element according to claim 6, further comprising a back electrode disposed on the second dielectric layer which is made of aluminum.

9. The thin film light emitting element according to claim 6 having a threshold voltage and a memory width that is substanially independent of operating time from the point immediately after manfacture to at least 10 hours.

10. The thin film light emitting element according to claim 6, wherein the first dielectric layer is disposed on a transparent electrode which contains $In_2O_3$ or $Sn_2O_3$.

11. The thin film light emitting element according to claim 6, wherein the first dielectric layer contains a material selected from the group consisting of $SiO_2$, $Si_3N_4$, $Y_2O_3$ and $Ta_2O_5$.

12. The thin film light emitting element according to claim 6, wherein the semiconductor base material is selected from the group consisting of zinc selenide and zinc sulfide.

13. The thin film light emitting element according to claim 6, wherein the second dielectric layer contains an oxide selected form the group consisting of $SiO_2$, $Al_2O_3$, $Y_2O_3$, $Ta_2O_5$, $TiO_2$, $GaTiO_2$ and $GeO_2$.

14. The thin film light emitting element according to claim 6, wherein the second dielectric layer contains a nitride.

15. The thin film light emitting element as claimed in claim 6, wherein at least one of said first and second dielectric layers is of a two-layer construction including an oxiue layer portion held in contact with said light emitting layer and a dielectric layer portion abutting on said oxide layer portion such that siad oxide layer portion is interposed between said light emitting layer and said dielectric layer portion.

16. The thin film light emitting element as claimed in claim 15, wherein both said first and second dielectric layers are of a multi-layer construction.

17. The thin film light emitting element as claimed in claim 16, wherein said one of said first and second dielectric layers further includes an additional oxide layer portion stacked on said dielectric layer portion.

18. The thin film light emitting element as claimed in claim 17, wherein one of said first and second dielectric layers further includes an additional oxide layer portion stacked on said dielectric layer portion.

19. The thin film light emitting element as claimed in claim 8, wherein the oxide containing layer has a thickness of 50 to 1000 Angstroms.

* * * * *